United States Patent [19]

Vinnemann et al.

[11] 4,204,414

[45] May 27, 1980

[54] CLAMPING MEANS FOR MATERIAL IN THREAD, RIBBON OR STRIP FORM

[75] Inventors: Antonius Vinnemann; Heinrich Elsässer, both of Stuttgart; Manfred Walter, Grötzingen; Willi Gaiser, Gäufelden, all of Fed. Rep. of Germany

[73] Assignee: Sulzer Morat GmbH, Fed. Rep. of Germany

[21] Appl. No.: 956,415

[22] Filed: Oct. 31, 1978

[30] Foreign Application Priority Data

Oct. 31, 1977 [DE] Fed. Rep. of Germany ..... 2748841

[51] Int. Cl.[2] ..... D04B 35/00

[52] U.S. Cl. ..... 66/145 R; 66/64

[58] Field of Search ..... 66/134, 140 R, 142, 66/145, 63, 64; 24/261 R, 131 R, 129 R

[56] References Cited

U.S. PATENT DOCUMENTS

| | | | |
|---|---|---|---|
| 677,908 | 7/1901 | Wegner | 24/131 |
| 1,764,778 | 6/1930 | Carlson | 24/261 R |
| 2,088,208 | 7/1937 | Kassap | 24/261 |
| 2,537,663 | 1/1951 | Geiger | 24/261 R |
| 3,368,187 | 2/1968 | Faul et al. | 24/131 |

*Primary Examiner*—Ronald Feldbaum

[57] ABSTRACT

The clamping means, which has a clamping position and an open position for material in thread, ribbon or strip form, has an element which, in accordance with the invention, is resiliently bent double hairpin-wise in a first plane and has two arms of substantially equal length, the end of the first arm being bent double to a U shape in a second plane such that the gap between the two limbs of the U formed by this bend is smaller than the cross section of the portion of the free end of the second arm which cooperates with it, and the ends of the two arms being offset from one another parallel to the second plane such that, in the closed position, the free end of the second arm engages both limbs of the U in the area of the gap.

18 Claims, 7 Drawing Figures

CLAMPING MEANS FOR MATERIAL IN THREAD, RIBBON OR STRIP FORM

BACKGROUND

Clamping means having a clamping position and an open position for material in thread, ribbon or strip form serve in knitting machines and looms for clamping the free end of a thread coming from a supply spool for as long as the clamped thread is not needed for a knitting or weaving operation for which it has to be drawn from the supply spool.

Most of the known clamping means contain a clamping pin under spring bias, by means of which the thread is pressed against a clamping surface (e.g., German Offenlegungsschrift Nos. 23 25 747 and 24 10 415, or German Auslegeschrift No. 16 35 868). Owing to the fact that these clamping means consist of a plurality of parts, and a relatively complex opening and closing mechanism is needed to operate them, they are unsuitable especially when it is important to accommodate them within a very small amount of space. Other known thread clamping means operate by vacuum (German Auslegeschrift No. 11 48 347) and therefore they are suitable as a rule only when they can be mounted in a stationary manner.

In a number of applications, especially in knitting machines of the kind designated in the generic part of claim 10, a plurality of relatively small thread carriers is provided, which circulate on an endless path and release the thread at the beginning of a working section so that it can be laid in the knitting needles and looped. At the end of the work section, the thread is cut by a cutting means and the thread end is clamped and carried back along a return run to the beginning of the working run. In these cases, too, the clamping means are relatively costly clamping pins which take up a great deal of space and whose operation is complex (e.g., German Offenlegungsschrift Nos. 23 51 741 and 25 31 734).

THE INVENTION

The object of the invention, therefore, is to create a clamping means which can be accommodated in a minimum of space and can be opened and closed in a simple manner.

In achieving this object, the invention is characterized by a resilient element bent double in a first plane and having two arms of substantially equal length, the end of the first arm being bent double in a second plane to a U-shaped configuration such that the gap between the two limbs of the U obtained by this second bend is smaller than the cross section of the portion of the free end of the second arm which cooperates therewith, and the ends of the two arms being offset from one another parallel to the second plane such that, in the clamping position, the free end of the second arm engages both limbs in the area of the gap.

The invention offers the advantage that the entire clamping means can be made of a single piece of spring wire or plastic, for example, and in this case the clamping pin, the clamping surface and the spring of conventional clamping means can be combined in a single component. The special form of the clamping means of the invention furthermore provides the assurance that the free end of the one arm will, when in the clamping position, engage both of the limbs of the U formed at the end of the other arm, producing a secure clamping of the thread at at least two points. If, in accordance with one advantageous embodiment of the invention, the two limbs of the U formed in the one arm and the cooperating end of the other arm have a cross section of polygonal shape, e.g., an equilateral triangle, the thread will then be held between two pairs of clamping surfaces which automatically engage one another.

Additional advantageous features of the invention are described in the subordinate claims.

The invention will be further explained below with the aid of examples of its embodiment in conjunction with the appended drawing, wherein.

Figure 1:
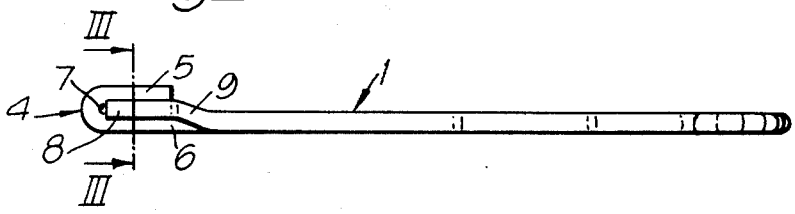
FIG. 1 is a side view of the clamping means of the invention.
Figure 3A:
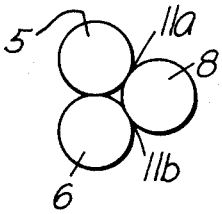
Figure 3B:
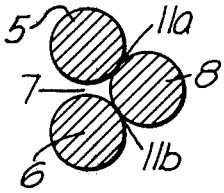
Figure 3C:
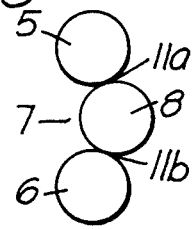
Figure 4:
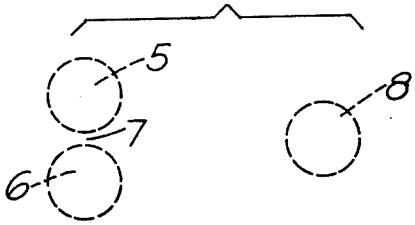
Figure 5:
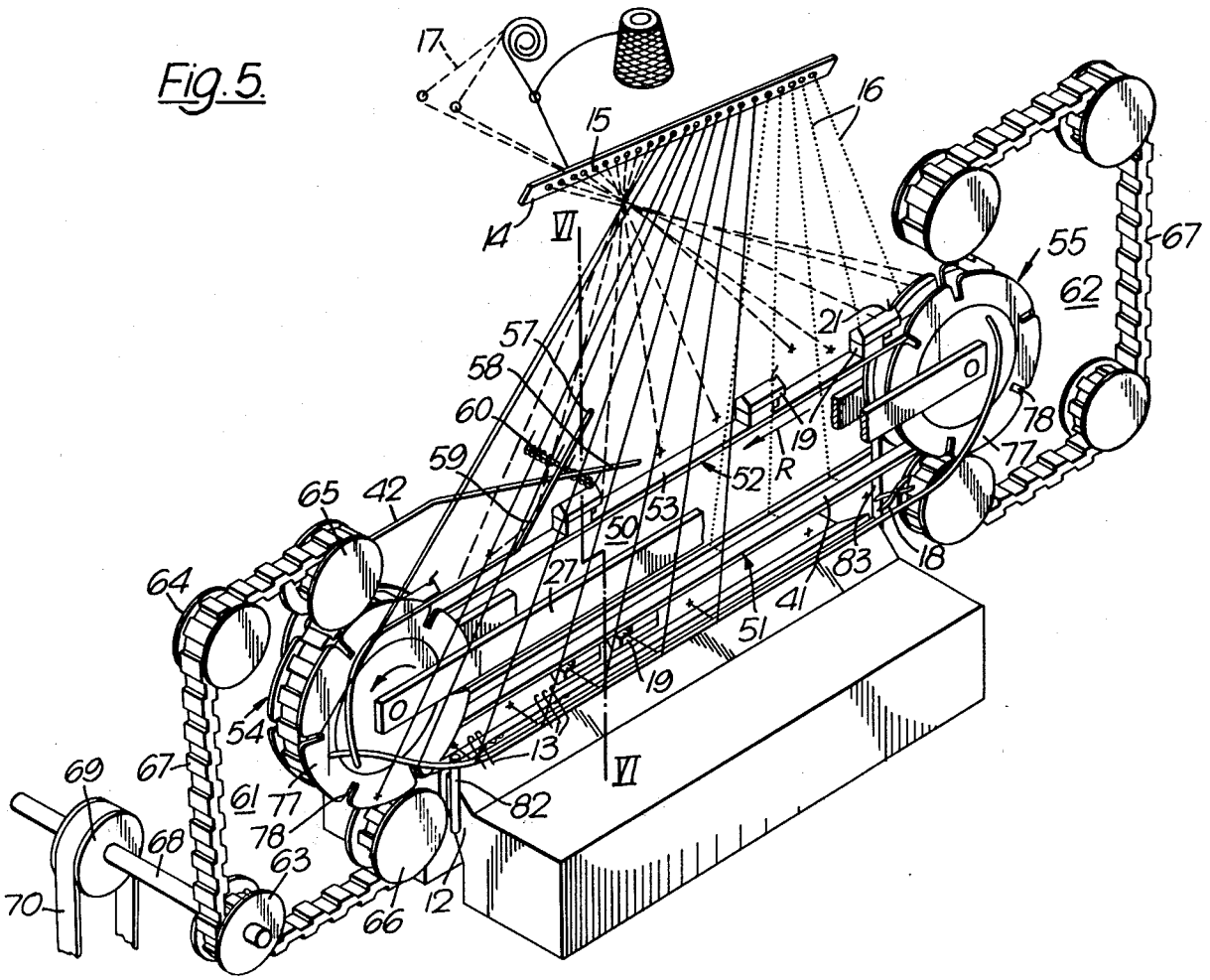
Figure 6:
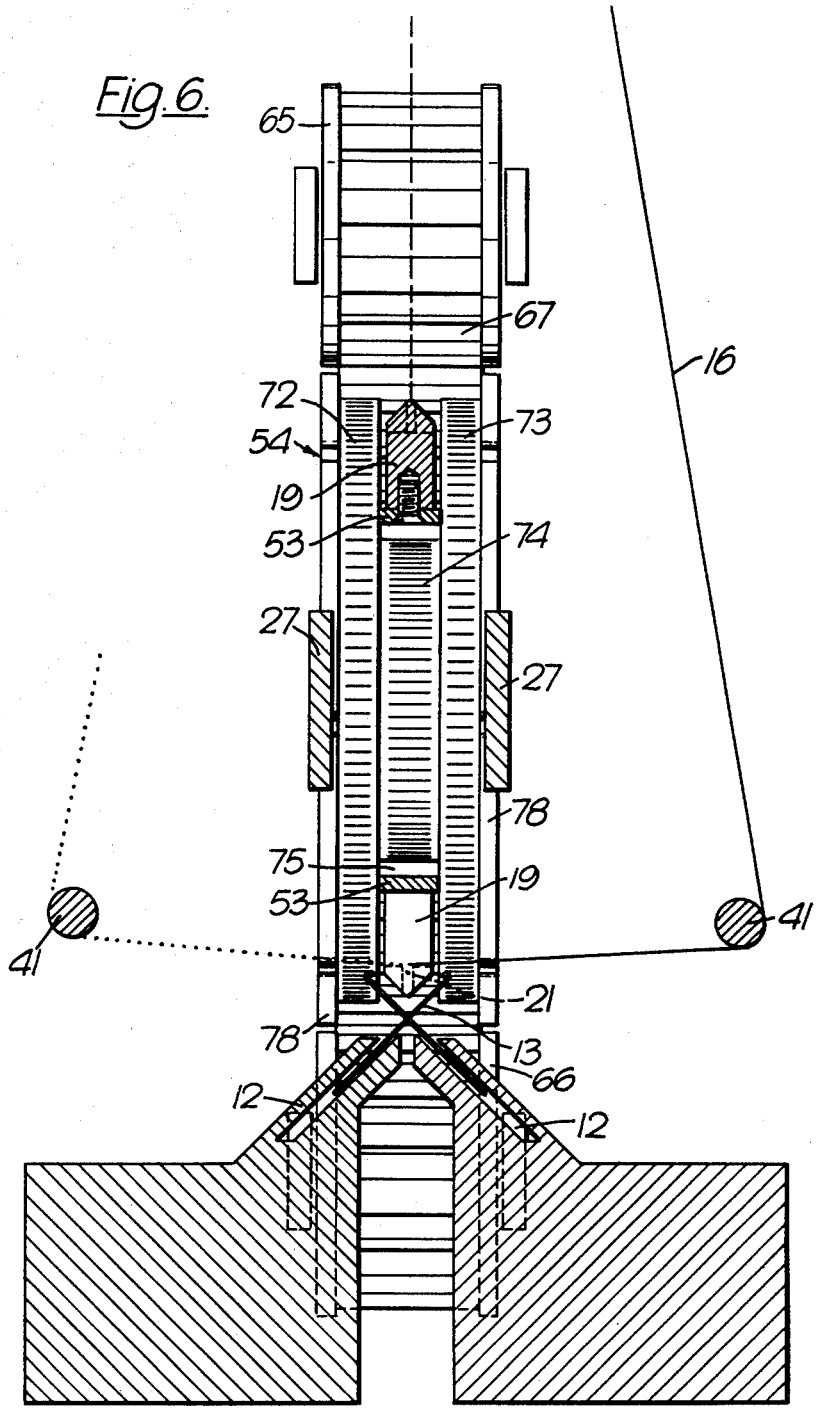

FIGS. 3*a* to 3*e* are greatly enlarged views of a cross section taken along line III—III of FIG. 1 through clamping means having different cross sections at their ends, each represented in the closed position;

FIG. 4 is a greatly enlarged view of the ends of the clamping means of FIG. 3*b* in the open position;

FIG. 5 is a perspective diagrammatic view of a flat-bed knitting machine particularly suited for the application of the clamping means of FIGS. 1 to 4;

FIG. 6 is a cross-sectional view taken along line VI—VI of FIG. 5, and

Figure 2:
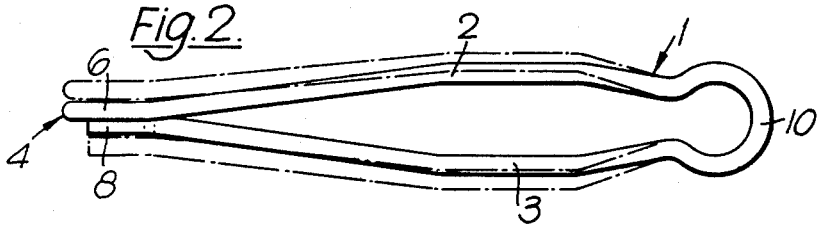
FIG. 2 is a top view of the clamping means of FIG. 1, showing the open position in broken lines and the clamping position in solid lines.
Figure 7:
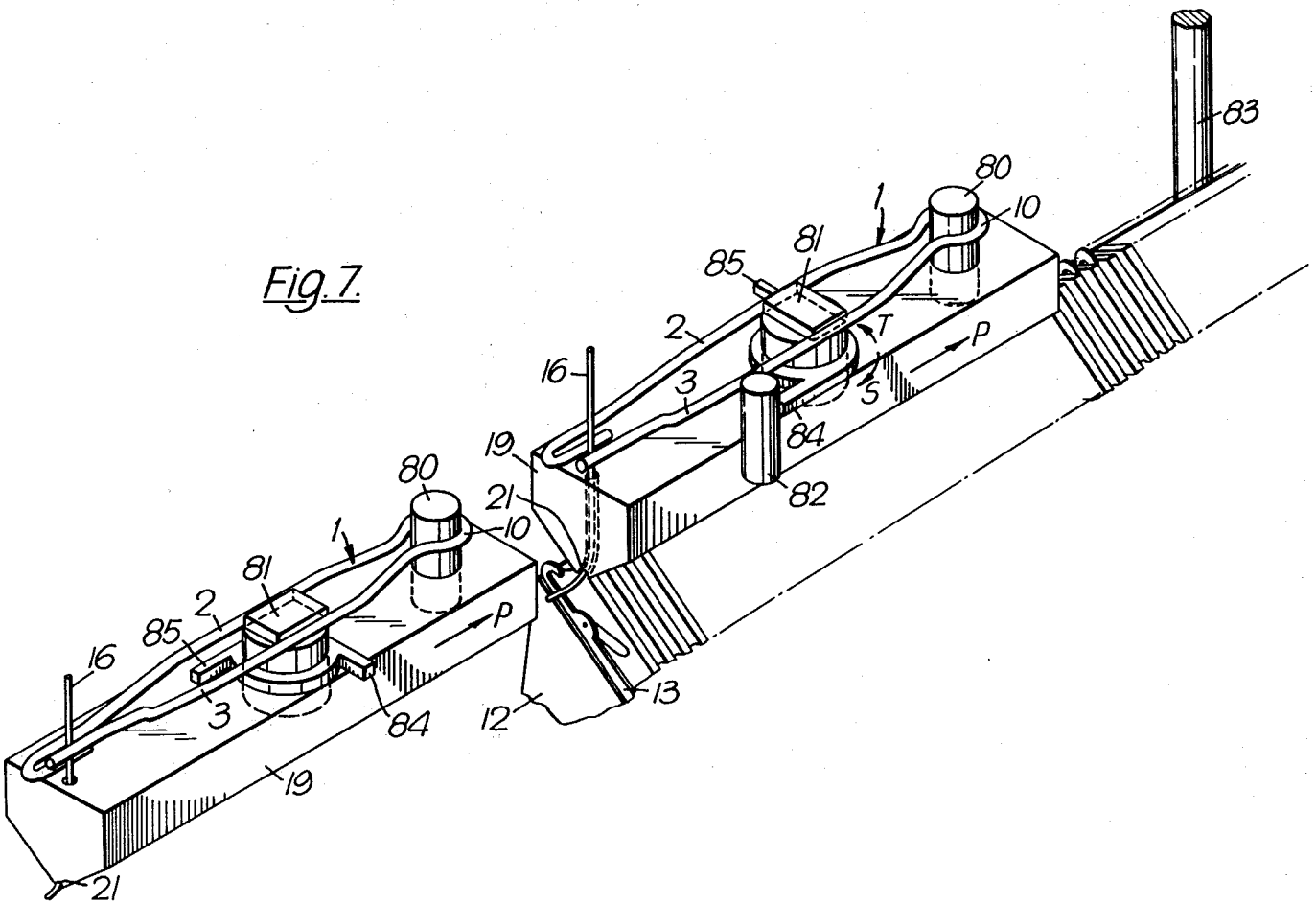

FIG. 7 is a diagrammatic representation of an opening and closing mechanism for the clamping means of FIGS. 1 and 2 in conjunction with a flat-bed knitting machine in accordance with FIGS. 5 and 6.

In the embodiment represented in FIGS. 1 and 2, a clamping means 1 of the invention comprises an element bent double hairpin-wise, having two arms, 2 and 3, which are of substantially equal length and are disposed in the plane of the drawing in FIG. 2. The end 4 of the one arm 2 is bent double to a U-shaped configuration in a plane perpendicular to the plane of drawing of FIG. 2, and therefore it has two limbs 5 and 6. The gap 7 between these limbs 5 and 6 is smaller than the cross section of the free end 8 of the other arm 3 which cooperates with them. Furthermore, the ends 4 and 8 are offset from one another in the second plane, which is the plane of drawing in FIG. 1, such that the free end 8, when in the clamping position represented in FIG. 2, will engage both of the limbs 5 and 6 of arm 2 in the area of the gap 7, the open position and the closed position being brought about essentially by moving the two arms 2 and 3 relative to one another in the first plane and parallel to the first plane.

The clamping means 1 represented in FIGS. 1 and 2 consists preferably of a resilient material, such as spring wire, for example. The spring wire can be so bent and biased that the two arms 2 and 3, if left to themselves, will assume the clamping position seen in FIG. 2, although it is also possible for the arms 2 and 3 to be biased normally to the open position also seen in FIG. 2. To assure that the free end 8 of arm 3 will engage the two limbs 5 and 6 of end 4 in the clamping position, the arm 3 preferably has, at some point between its extremities, an S-shaped bend 9 disposed in the second plane. To facilitate mounting and precise positioning, a C-shaped loop 10 is also provided in the portion where the two arms join.

Figure 3D:
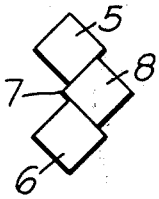
Figure 3E:
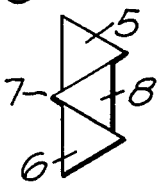

As represented in FIGS. 3*a* to 3*e*, the clamping means 1 has a cross section, especially at its ends 4 and 8, of circular shape (FIGS. 3*a* to 3*c*), or of square shape (FIG. 3*d*) or of equilateral triangular shape (FIG. 3*e*). As shown especially in FIGS. 3*a* to 3*c*, this brings it about that the material in thread, ribbon or strip form will be clamped at at least two points 11*a* and 11*b*, and the additional advantage is achieved that this clamping action will occur even if the engaged clamping surfaces are not ideally pressed together or if the end 8 is not precisely centered between the limbs 5 and 6. As additionally seen in FIGS. 3*a* to 3*c*, the width of the gap 7 is largely uncritical with regard to the clamping function, and the two limbs 5 and 6 can even be in contact with one another without impairing the clamping function. This substantially simplifies the manufacture of the clamping means 1.

The cross sections seen in FIGS. 3*d* and 3*e* offer the advantage that the ends 4 and 8 are in broad-area engagement at two points and therefore have a better clamping effect. In these embodiments, care must be taken in manufacture to see to it that no undesirable twist is produced in the arms 2 and 3.

FIG. 4 shows the relative position of the free end 8 and limbs 5 and 6 in the open position.

The above-named advantages of the clamping means 1 of the invention are largely independent of whether the normal position of the clamping means is the open or the clamping position.

In FIG. 5 there is shown a flat-bed knitting machine which is especially suitable for the application of the clamping means of the invention. This machine has a frame having two needle beds 12 disposed in the manner of an inverted V; knitting needles 13 are guided in the bed grooves for longitudinal displacement in a known manner. The knitting needles 13, when they are all fully extended, define a working area extending parallel to the needle beds 12 and disposed just above the crossing formed by the knitting needles 13, on which the threads have to be presented to the knitting needles so that they can be caught by the latter and formed into loops. Other details of the flat-bed knitting machine which are not necessary for the comprehension of the invention can be learned, for example, from German Offenlegungschrift Nos. 25 31 762, 25 31 705 and 25 31 734.

Above the machine there is provided a stationary eyeboard 14 disposed preferably parallel to the work area, through whose eyes 15 a plurality of threads 16 are guided from stationary supply spools to a plurality of thread carriers 19 having inserting means in the form of thread guiding eyes 21, and above the eyeboard 14 there is indicated one thread storage 17 for each thread 16, which serves for the temporary storage of the pieces of thread as they are released.

For the transport of the thread carriers 19 there is provided an endless circulator generally designated at 50 having a work run 51 and a return run 52. The work run 51 is situated above the line of action of the inserter 21. The return run 52 is disposed between the work section 51 and the eyeboard 14. The circulator 50 comprises an endless, flexible belt 53 on which the thread carriers 19 are fastened, and which is mounted on two pulleys 54 and 55 rotatable on shafts held at the ends of a pair of rigid rails 27. To bring it about that the threads 16, in the repeated circulation of the thread carriers 19 in the direction of the arrow R, will be arrayed alternately on the one and on the other broad side of the circulator 50 and consequently will not become entangled, two guide rods 57 and 58 are provided which form an entrance throat, and a deflector 59 is provided, which can be shifted from the position represented by continuous lines in FIG. 5 to the position indicated by broken lines, and vice versa, by means of two electromagnets 60 which are connected to a control system by a cable which is not shown. The deflector 59 is followed by two guide wires 42 which take the threads 16, which are distributed by means of deflector 59 to one or the other broad side of the circulator 50 and transfer them to a guide rail 41 so as to assure that the threads will not come into contact with any parts of the thread carrier system or of the knitting machine.

To prevent the mounting of the circulator 50 from interfering with the guidance of the threads, a support system 61 is provided at one end and another support system 62 is provided at the other end of the circulator 50 so as to provide a floating support for the circulator 50, which acts on the outer periphery of the end pulleys 54 and 55. Each of the support systems 61 and 62 consists of four support pulleys 63, 64, 65 and 66, which are journalled outside of the circulator 50 in a frame which is not represented. It is desirable that the support system 61 also serve as the means for driving the belt 53 carrying the thread carriers 19. For this purpose support belts 67 are laid around the support pulleys 63 to 66, one engaging the end pulley 54 and the other engaging end pulley 55, and they support and drive those pulleys. The support belt 67 is preferably provided inside and out with teeth which mesh with corresponding teeth on the outer periphery of support pulleys 63 to 66 and end pulleys 54 and 55, preventing any slippage of the support belt 67. The support pulley 63 is connected to a drive having an additional pulley 69 fastened to the shaft 68 of support pulley 63, the additional pulley 69 being coupled by a belt 70 or the like to the drive pulley of a motor.

The construction of the end pulleys 54 and 55 is to be seen in the detail drawing in FIG. 6. Each end pulley consists of two disks 72 and 73 whose periphery is engaged by the support belt 67, and between which there is fastened a coaxial drive pulley 74 on which belt 53 is carried, which bears the thread carriers 19. On the outer periphery of the drive pulley 74 and on the inside of belt 53, suitable teeth 75 can be provided for the prevention of slippage of belt 53. The outside diameter of the drive pulley 74 is smaller than the outside diameter of the pulley disks 72 and 73 to such a degree that the thread carriers 19, when passing over the end pulleys 54 and 55, as indicated in FIG. 6, can be fully accommodated in the space between the peripheries of disks 72 and 73 and of drive pulleys 74.

In order to prevent the threads 16, after being deflected to one side or the other of the circulator 50 by the switch 59 and transferred to the guide rails 42 and 41, from being damaged while the corresponding thread guides 19 pass over the end pulleys 54 and 55, radial slots are provided in the outer periphery of the disks 72 and 73. Corresponding radial slots 78 (FIG. 5) are formed in side disks 77 which are fastened coaxially on the outer sides of the disks 72 and 73 and have a slightly larger diameter than the latter, to prevent the support belt 67 from slipping off.

The operation of the thread carrier in FIGS. 5 and 6 is as follows: In the repeated circulation of the thread guides 19, the threads 16 are cut off at the end of the work area by means of a cutting device 18, and are held by clamping means which are disposed in the thread carriers 19. The clamped thread ends are carried back to the start of the work area and there they are again released from the clamping means. Each thread 16, after traveling the length of belt run 53, reaches the deflector 59 and is deflected by the latter alternately to one side or the other of the circulator 50. For better comprehension, all of the threads which are deflected to the front side of the circulator 50 in FIG. 5 are represented by a continuous line, while those deflected to the rear side are represented by a dotted line, and undeflected threads are represented by a broken line. At the moment represented in FIG. 5, the inserters 21 of the last two threads represented by dotted lines and the five first threads 16 represented in continuous lines are within the work area, while the corresponding thread carriers 19 are passing through the work section 51. The threads corresponding to the dotted lines are guided from the rear side, and those of the continuous lines from the front side of the circulator 50 (cf. German patent application No. P 27 01 652).

For the clamping of the threads 16, a clamping means 1 in accordance with FIGS. 1 to 4 is mounted on each thread carrier 19, as shown in FIG. 7, being fastened by means of the C-shaped loop 10 on a mounting pin 80 and extending parallel to the direction of movement of the thread guides 19 which is indicated by an arrow P. To open and close the clamping means 1, an opening and closing mechanism is provided which consists of a stepping cam 81 journaled on each thread carrier 19 between the arms 2 and 3, and cam operating pins 82 and 83 disposed, one at the beginning and the other at the end of the work area, cam operating pin 82 being disposed on the right side and cam operating pin 83 on the left side of the thread carriers, as seen in the direction of arrow P. The stepping cam 81 has a rectangular cross section, and the two arms 2 and 3 of the clamping means 1 are biased against one another such that, when the stepping cam 81 is in the position represented in the left-hand portion of FIG. 7, in which they engage the two long sides of the stepping cam, the arms of the clamping means will be in the clamping position on account of their bias, whereas when the stepping cam 81 is in the position represented in the right-hand part of FIG. 7, in which the arms engage the two short sides of the cam, the clamping arms are held in the open position against the bias.

As seen in FIG. 7, two cam operating arms 84 and 85 are fastened underneath the stepping cam 81 and form together an angle of 90°. Therefore, if a thread carrier 19, for example the one shown on the left in FIG. 7, approaches the work area, the corresponding clamping means 1 will be in the clamping position, and the cam operating arm 84 will project straight outward to the right (or front, as seen in the figure), so that the stepping cam 81 will be rotated 90°, in the direction of an arrow S when the cam operating arm 84 encounters the cam operating pin 82, and the clamping means will be changed to the open state. This open state, which is represented in the right side of FIG. 7, will be assumed by the clamping means 1 as long as it is moving through the work area, so that the thread 16 can be inserted into the knitting needles be pulled from the supply spool, and worked into loops. At the end of the work area, the cam operating arm 85, which now projects leftwardly outward (or to the rear), will encounter the cam operating pin 83, whereby the stepping cam 81 will be turned back 90° in the direction of an arrow T and the clamping means 1 will be returned to the clamping state represented in the left part of FIG. 7. With the clamping means 1 in this state, the thread end clipped by the cutting means 18 will be carried by the corresponding thread carrier 19 along the return course and back to the work area.

The invention is not restricted to the embodiments described above. The clamping means 1, for example, can be made of plastic instead of spring wire, and the bends 9 and 10 shown in FIGS. 1 and 2 can have a different form. With regard to the opening and closing mechanism, it is to be noted that, if a clamping means is used which is normally open, suitable guide rails are preferably disposed along the work area, by means of which the two arms 2 and 3 will be forced to the clamping position. Still other opening and closing means, especially other stepping cams, are usable, provided they produce the opening and closing action in the manner described. Lastly, the invention is not restricted to knitting machines of the type described in FIGS. 5 to 7, but it can also be used in conjunction with other knitting and weaving machines, and whereever material in thread, ribbon or strip form is to be momentarily clamped and released.

We claim:

1. Clamping means having a clamping position and an open position for clamping and releasing material in thread, ribbon or strip form as fed to a textile machine of the group including knitting and weaving machines, characterized by an element bent U-wise and resiliently in a first plane and having two arms (2,3) of substantially equal length, the end (4) of the first arm (2) being bent back U-wise in a second plane in such a manner that the gap (7) between the two limbs (5,6) obtained by this bending is smaller than the cross section of the portion of the free end (8) of the second arm (3) which cooperates therewith, and the ends (4,8) of the two arms (2,3) being offset from one another parallel to the second plane such that the free end (8) of the second arm (3) engages both limbs (5,6) in the area of the gap (7) in the clamping position, and said element having means for mounting it on an associated part of the textile machine.

2. Clamping means of claim 1, characterized in that the two arms (2, 3) are biased against one another by spring force such that their ends (4, 8) normally assume the clamping position.

3. Clamping means of claim 1, characterized in that it consists of spring wire.

4. Clamping means of claim 1, characterized in that at least the two limbs (5, 6) of the first arm (2) and the end (8) of the second arm (3) cooperating therewith have a circular cross section.

5. Clamping means of claim 1, characterized in that at least the two limbs (5, 6) of the first arm (2) and the end (8) of the second arm (3) cooperating therewith have a cross section in the form of a polygon.

6. Clamping means of claim 5, characterized in that the cross section has the form of an equilateral triangle.

7. Clamping means of claim 1, characterized in that said mounting means is a C-shaped loop (10) in the area of the junction of the two arms (2, 3).

8. Clamping means of claim 1, characterized in that the second arm has a central section having an S-shaped bend (9) parallel to the second plane.

9. Clamping means of claim 1, characterized in that the two planes are disposed substantially perpendicularly to one another.

10. Knitting machine comprising: at least one needle bed in which knitting tools are mounted; a plurality of material carriers for the feeding of materials in thread, ribbon or strip form to the knitting tools, the material carriers running around on at least one endless track having a work section and a return section, and each have a clamping means whereby the fed materials are clamped at the end of the work section and released again at the start of the work section; and at least one material cutting means which goes into action at the end of the work section for cutting the materials fed by said material carriers, wherein the clamping means (1) have a clamping position and an open position for said material and include an element bent U-wise and resiliently in a first plane and have two arms (2,3) of substantially equal length, the end (4) of the first arm (2) being bent back U-wise in a second plane in such a manner that the gap (7) between the two limbs (5,6) obtained by this bending is smaller than the cross section of the portion of the free end (8) of the second arm (3) which cooperates therewith, and the ends (4,8) of the two arms (2,3) are offset from one another parallel to the second plane such that the free end (8) of the second arm (3) engages both limbs (5,6) in the area of the gap (7) in the clamping position.

11. Knitting machine of claim 10, characterized in that each clamping means (1) is mounted by a C-shaped loop (10) on a support pin (80) of the material carrier (19) associated with it and extends in the direction of movement of the material carrier (19), and that an opening and closing mechanism is associated with each clamping means (1).

12. Knitting machine of claim 11, wherein the two arms (2,3) are biased against one another by spring force such that their ends (4,8) normally assume the clamping position, and wherein the opening and closing mechanism has a stepping cam (81) disposed between the two arms (2,3) of the clamping means (1) and has operating pins (82,83) for the actuation of the stepping cam (81), one at the beginning and the other at the end of the work section.

13. Knitting machine of claim 12, characterized in that the stepping cam (81) has a section of comparatively large diameter corresponding to the open position of the clamping means (1) and a section of comparatively small diameter corresponding to the closed position of the clamping means, the active edges of these two sections lying in the first plane, and in that the stepping cam (81) is mounted for rotation about an axis perpendicular to the first plane.

14. Knitting machine of claim 13, characterized in that the stepping cam (81) has a substantially rectangular cross section.

15. Knitting machine of claim 12, characterized in that the stepping cam (81) has two cam operating arms (84, 85) cooperating with the cam operating pins (82, 83).

16. Knitting machine of claim 15, characterized in that the cam operating arms (84, 85) are disposed substantially in a plane parallel with the first plane and together form an angle of about 90° with reference to the axis of rotation of the stepping cam (81), and in that the cam operating pins (82, 83) are diposed on different sides of the circulation path.

17. Knitting machine of claim 11, characterized in that the two arms (2, 3) of the clamping means (1) are so biased that their ends (4, 8) normally assume the open position, and in that the opening and closing mechanism has at least one gripping device for closing the clamping means.

18. Knitting machine of claim 17, characterized in that the gripping device has a guide rail disposed parallel to the work section.

* * * * *